US006598541B2

(12) United States Patent
Vilkki

(10) Patent No.: US 6,598,541 B2
(45) Date of Patent: Jul. 29, 2003

(54) PALLET WITH STIFFENING ELEMENTS

(75) Inventor: Antti Vilkki, Jämsänkoski (FI)

(73) Assignee: UPM - Kymmene OYJ, Helsinki (FI)

( * ) Notice: Subject to any disclaimer, the term of this patent is extended or adjusted under 35 U.S.C. 154(b) by 0 days.

(21) Appl. No.: 09/908,842

(22) Filed: Jul. 20, 2001

(65) Prior Publication Data

US 2002/0007770 A1 Jan. 24, 2002

(30) Foreign Application Priority Data

Jul. 20, 2000 (DE) ..... 100 35 411

(51) Int. Cl.[7] ..... B65D 19/00
(52) U.S. Cl. ..... 108/51.11
(58) Field of Search ..... 108/51.11, 55.1, 108/55.3, 55.5, 57.3, 57.32, 57.33, 56.1, 57.17

(56) References Cited

U.S. PATENT DOCUMENTS 1,749,270 A * 3/1930 Young
2,720,323 A * 10/1955 Hoiles
3,294,041 A * 12/1966 Lessheim
3,425,472 A * 2/1969 Marino
3,552,329 A * 1/1971 Parris
3,675,596 A * 7/1972 Colas
3,858,526 A * 1/1975 Lombard et al.
4,013,168 A * 3/1977 Bamburg et al.
4,015,715 A 4/1977 Kelf
4,159,681 A * 7/1979 Vandament
4,165,806 A * 8/1979 Cayton
4,416,385 A 11/1983 Clare et al.
4,931,340 A * 6/1990 Baba et al.
5,183,375 A 2/1993 Fenton et al.
5,413,052 A * 5/1995 Breezer et al.
5,473,995 A * 12/1995 Gottlieb
5,809,902 A * 9/1998 Zetterberg
5,890,437 A * 4/1999 Hill
5,894,803 A * 4/1999 Kuga

FOREIGN PATENT DOCUMENTS

FR 2 259 779 8/1975

* cited by examiner

*Primary Examiner*—Jose V. Chen
(74) *Attorney, Agent, or Firm*—Young & Thompson

(57) ABSTRACT

A pallet including a frame (2) whose upper part, at least at sides thereof, is provided with edges (4) projecting from the pallet (1'), a frame structure being arranged inside the frame (2), and a loading surface (5) onto which a load (17) is to be arranged. Both sides of the pallet (1') are provided with stiffening elements (10, 22) arranged to stiffen the pallet (1') in its longitudinal direction, enabling the pallet (1'), even while carrying a load, to be lifted without the pallet (1') substantially bending in the longitudinal direction.

21 Claims, 5 Drawing Sheets

PALLET WITH STIFFENING ELEMENTS

BACKGROUND OF THE INVENTION

The present invention is directed to a pallet having a frame whose upper part, at least sides thereof, is provided with edges projecting from the pallet, a frame structure being arranged inside the frame, the pallet further including a loading surface onto which a load is to be arranged.

DESCRIPTION OF THE RELATED ART

In a known pallet, the frame which forms the framing or framework of the pallet is implemented such that the sides and ends of the pallet are provided with edges projecting from the pallet. Such a structure is achieved e.g. by using interconnected L-shaped bars turned upside down or appropriately profiled rails. In order to strengthen the structure of the pallet, a frame structure is arranged inside the frame of the pallet, comprising bars running across the pallet. Excluding the corners of the pallet, the upper part of the pallet is provided with a loading surface made of plywood, onto which a load is to be arranged. On top of the loading surface, in turn, there is a friction surface made of rubber sheet arranged to prevent the load from moving on the pallet and to suppress vibrations and impacts the load is subjected to. The pallet is designed to be moved by a particular road transport means which comprises an open bottom cargo space and which is capable of receiving and carrying a pallet and a load arranged thereon without being assisted by a forklift truck or a loader. The corners of the pallet are provided with corner elements through which locking holes are formed. The pallet can be locked to the above transport means using locking elements to be arranged into the locking holes such that the pallet forms the bottom of the cargo space of the transport means, stiffening the structure of the transport means. The aim is to make the structure of the pallet as low and as light as possible. The low structure of the pallet enables rather tall loads to be transported in the cargo space of the transport means. The lightness of the pallet enables the proportion of effective load from the total weight of the transport means to be raised as high as possible. Despite the frame and the frame structure inside the frame, due to the above reasons the pallet is very flexible, however, which is why in practice the pallet, particularly while carrying a load, can only be lifted almost exclusively by lifting means which support the pallet by the edges on the sides of the pallet substantially over the entire length of the pallet. This restricts the usability of the pallet in railroad traffic and sea transport since the pallet cannot be lifted and moved by loaders arranged to lift e.g. containers by their ends that are typically used in terminals and ports.

SUMMARY OF THE INVENTION

An object of the present invention is to provide an improved pallet which is easy to use also in railroad traffic and sea transport.

The pallet of the invention is characterized in that both sides of the pallet are provided with stiffening elements arranged to stiffen the pallet in its longitudinal direction, enabling the pallet, even while carrying a load, to be lifted without the pallet substantially bending in the longitudinal direction.

According to the basic idea of the invention, a pallet comprising a frame whose upper part, at least sides thereof, is provided with edges projecting from the pallet, a frame structure being arranged inside the frame, the pallet further comprising a loading surface onto which a load is to be arranged, can be stiffened in the longitudinal direction by means of stiffening elements to be arranged in both sides of the pallet, enabling the pallet, even while carrying a load, to be lifted without the pallet substantially bending in the longitudinal direction. According to a preferred embodiment of the invention, both sides of the pallet are provided with separate stiffening elements arranged to stiffen the pallet in the longitudinal direction, enabling the pallet, even while carrying a load, to be lifted by its ends without the pallet substantially bending in the longitudinal direction. According to a second preferred embodiment of the invention, the corners of the pallet are provided with corner elements comprising locking holes, the sides and ends of the pallet, excluding the point where the corner elements are located, being provided with recesses or reductions, enabling the pallet to be stiffened by means of the stiffening elements such that the total width and/or total length of a stiffened pallet corresponds to the total width and/or total length of the original unstiffened pallet. According to a third preferred embodiment of the invention, a fixed protective housing to protect the load is arranged in connection with the stiffening elements such that the stiffened pallet and the fixed protective housing constitute a container which is fit for sea transport and which can be lifted by its ends.

An advantage of the invention is that in addition to road transport, the pallet can easily and simply also be used in railroad traffic and sea transport since the pallet, even while carrying a load, can be lifted and moved by cranes and loaders ordinarily used in terminals and ports by employing auxiliary equipment. The fixed protective housing enables a stiffened pallet to be made into a compact container already at the factory, while loading cargo. When the size of the stiffened pallet corresponds to the size of the bottom of a twenty-feet container used in sea transport, using the fixed protective housing enables the pallet to be turned into a container structure utilizing the cargo space of a ship to the full.

BRIEF DESCRIPTION OF THE DRAWINGS

The invention will be described in closer detail in the accompanying drawings, in which.

DESCRIPTION OF THE PREFERRED EMBODIMENT

Figure 1:
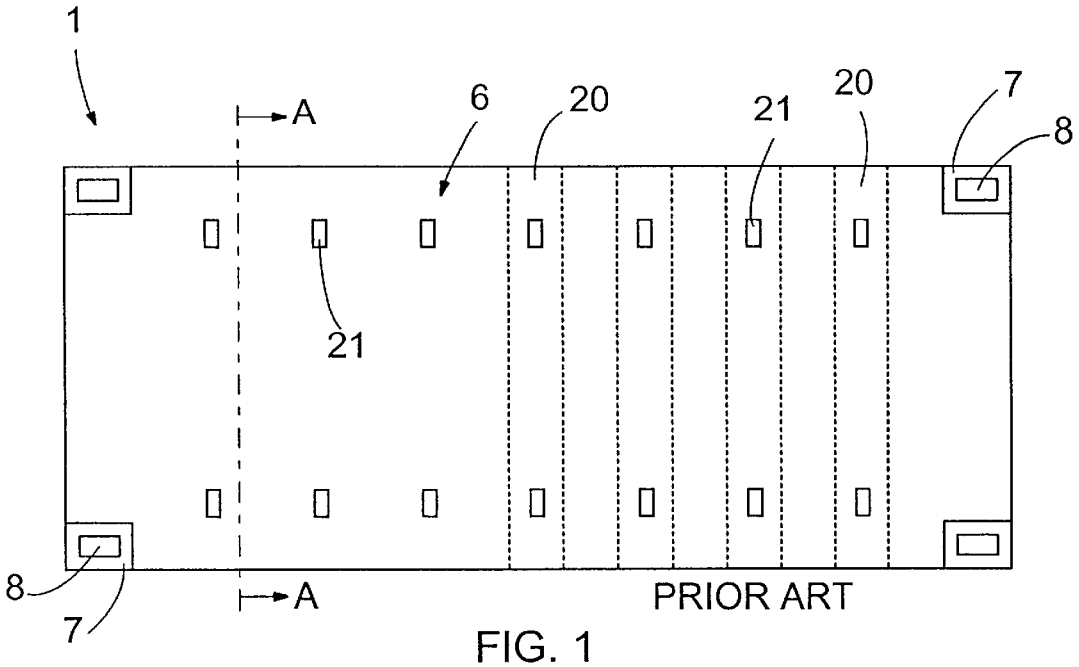
FIG. 1 is a schematic top view showing a prior art pallet.
Figure 2:
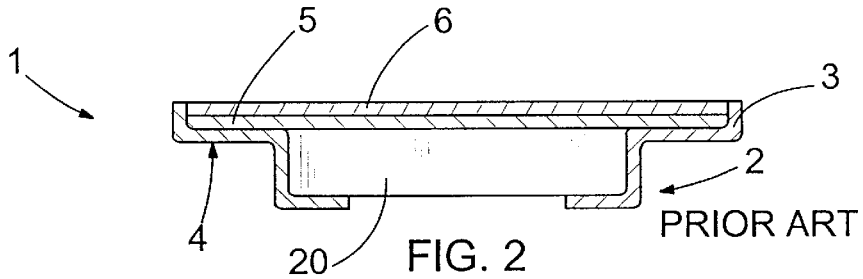
FIG. 2 is a schematic cross-sectional end view showing the pallet of FIG. 1.

FIG. 1 is a schematic top view showing a prior art pallet 1, and FIG. 2 is a schematic cross-sectional end view showing the pallet of FIG. 1 along line A—A in FIG. 1. The pallet 1 of FIGS. 1 and 2 comprises a frame 2, which constitutes the framing or framework of the pallet 1. The frame 2 is formed by interconnected, appropriately profiled rails 3 such that both sides and ends of the pallet 1 are provided with edges 4 projecting from the pallet 1. The frame 2 can also be formed e.g. using L-shaped bars turned upside down such that the sides and ends of the pallet 1 are provided with edges 4. Longitudinally and laterally, the size of the pallet 1 corresponds to that of the bottom of a twenty-feet container typically used in sea transport; however, the size of the pallet 1 may vary. Inside the frame 2 of the pallet 1, a frame structure is provided which comprises frame bars 20 running across the pallet 1; the frame bars 20 are shown in FIG. 1 by broken lines. For the sake of clarity, FIG. 1 only shows a couple of frame bars 20 at one end of the pallet 1, but it is obvious that there are frame bars 20 arranged in a similar manner over the entire length of the pallet 1. The pallet 1 further comprises a loading surface 5 made of plywood, onto which a load is to be arranged. On top of the loading surface 5 there is provided a friction surface 6 made of rubber sheet to prevent the load from moving along the loading surface 5 and to suppress vibrations and impacts the load is subjected to. For the sake of clarity, FIG. 2 shows the loading surface 5 and the friction surface 6 thicker than they actually are in comparison to the rest of the structure of the pallet 1. The corners of the pallet 1 are provided with corner elements 7 through which locking holes 8 are formed. The pallet 1 further comprises clamps 21, to which the load is attached by means of belts and clamping devices or the like. The pallet 1 is designed to be conveyed by a particular road transport means which comprises an open bottom cargo space and which is capable of receiving and carrying the pallet 1 and a load arranged thereon to be rested on the edges 4 of the pallet 1 without being assisted by a forklift truck or a loader. When the pallet 1 is interlocked with a particular transport means by means of locking elements to be arranged into the locking holes 8, the pallet 1 constitutes the bottom of the cargo space of the transport means, the bottom stiffening the structure of the transport means. Despite the structure of the frame 2 and the frame structure inside the frame 2, the pallet 1 is still flexible enough to be lifted, particularly when carrying a load, only by lifting means which support the pallet 1 at least by the edges 4 located on its sides substantially over the entire length of the pallet 1. The fact that the pallet 1 cannot be lifted e.g. by its ends without the pallet considerably bending in the longitudinal direction restricts the usability of the pallet 1 in railroad traffic and sea transport because the pallet 1 cannot be lifted and moved by loaders lifting e.g. containers by their ends that are typically used in terminals and ports.

Figure 3:
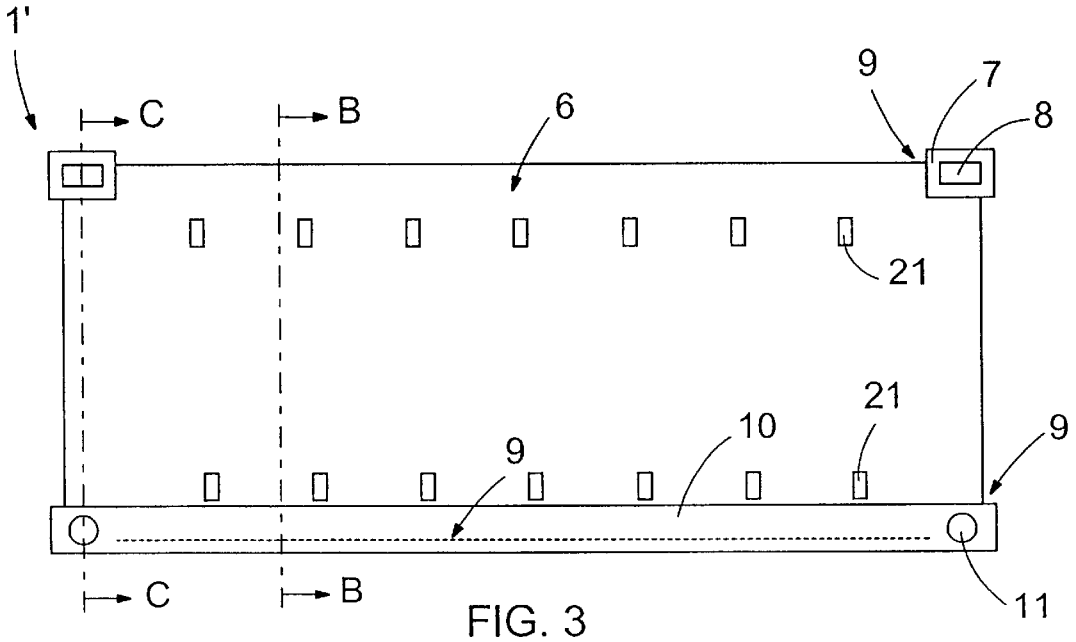
FIG. 3 is a schematic top view showing an embodiment of a pallet of the invention.
Figure 4:
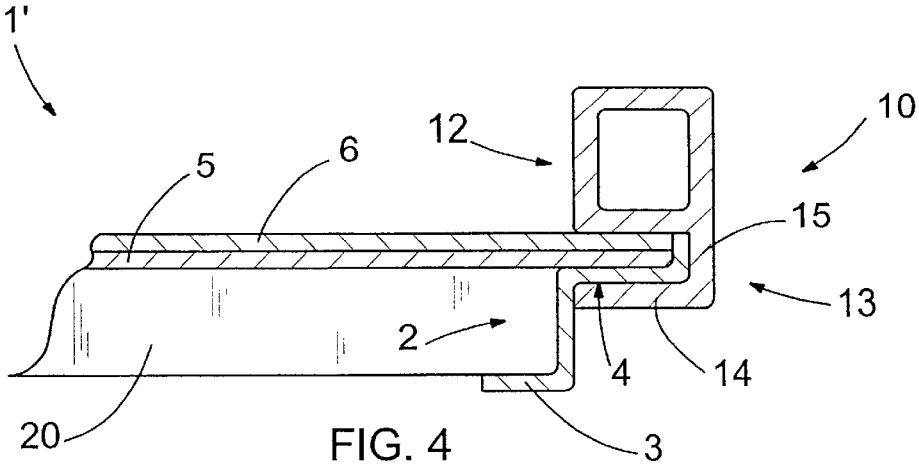
FIG. 4 is a schematic cross-sectional end view showing the pallet of FIG. 3.

FIG. 3 is a schematic top view showing a pallet 1' of the invention, and FIG. 4 is a schematic cross-sectional end view showing the pallet 1' of FIG. 3 along line B—B in FIG. 3. Excluding the point where the corner elements 7 are located, both sides and ends of the pallet 1' of FIG. 3 are provided with recesses or reductions 9. The reductions 9 are preferably about 20 mm wide; however, the width of the reductions 9 may vary. At the bottom of FIG. 3, the reduction 9 in a side of the pallet 1' is designated by a broken line. Both sides of the pallet 1' are provided with stiffening elements 10. For the sake of clarity, FIG. 3 only shows a stiffening element 10 in the side of the pallet 1' located at the bottom of FIG. 3 in order to make the reductions 9 in the sides and at the ends of the pallet 1' easier to illustrate. The stiffening element 10 has the same length as the pallet 1' and it can be locked into the locking holes 8 in the corner elements 7 by employing an ordinary procedure for locking containers in a manner known per se. In addition to or instead of this locking procedure, the stiffening elements 10 can be arranged in connection with the pallet 1' such that the stiffening elements 10 are attached to each other by means of supporting elements running across the pallet 1'. The stiffening elements 10 can be fastened to the pallet 1' also in many other ways; preferably, however, such that the stiffening elements 10 can be detached from the pallet 1'. The ends of the pallet 1' may also be provided with stiffening elements e.g. when a fixed protective housing is arranged in connection with the pallet 1'. The stiffening element 10 further comprises fastening points 11, to which e.g. the fixed protective housing to be arranged in connection with the pallet 1' can be fastened. The fastening points 11 may be e.g. openings provided in the stiffening element 10, the shape of the openings being allowed to vary in many ways. The stiffening elements 10 arranged in the sides of the pallet 1' stiffen the structure of the pallet 1' in the longitudinal direction, enabling the pallet 1', also while carrying a load, to be lifted and moved by loaders gripping the pallet 1' by its ends without the pallet substantially bending in the longitudinal direction. When the pallet 1' is provided with stiffening elements 10, the width of the stiffened pallet 1' corresponds to the width of the prior art, unstiffened pallet 1 shown in FIG. 1. Similarly, if both ends of the pallet 1' are provided with stiffening elements, the length of the pallet 1' corresponds to the length of the prior art pallet 1. The stiffening element 10 comprises a stiffening part 12 to be arranged on top of the pallet 1' which, in the embodiment of FIG. 4, resembles a hollow. However, the cross section of the stiffening element 10 may vary in many ways. The stiffening element 10 further comprises a gripping part 13 comprising a horizontal flange 14 to be arranged below the edge 4 of the pallet 1', and a vertical flange 15 connecting the stiffening part 12 and the horizontal flange 14. The height of the stiffening part 12 may vary, preferably being about 150–300 mm. The width of the stiffening part 12 may also vary, preferably being chosen such that about a 2250-mm-wide space is left for the load between the stiffening elements 10 if the size of the pallet 1' corresponds to that of the bottom of a twenty-feet container typically used in sea transport. The size of the gripping part 13 is designed to enable the stiffening element 10 to be firmly arranged in connection with the pallet 1'. The shape of the joint between the pallet 1' and the stiffening element 10 makes the joint a close one, preventing water from ascending on top of the pallet 1' from between the pallet 1' and the stiffening element 10. Furthermore, the friction surface 6 made of rubber sheet tightens the joint between the pallet 1' and the stiffening part 12. If the pallet 1' is not provided with a friction surface 6 or the friction surface 6 cannot be used for tightening purposes or the joint between the pallet 1' and the stiffening element 10 is otherwise to be made even tighter, a separate sealing element can be arranged between the pallet 1' and the stiffening element 10. For the sake of clarity, FIG. 4 shows the profiled rail 3, the loading surface 5 and the friction surface 6 clearly thicker than they typically are in comparison to the structure of the stiffening element 10.

A stiff pallet 1' can also be implemented by providing the pallet 1 with no reductions 9 but arranging the stiffening elements 10 directly in the pallet 1. After the pallet 1 has been provided with the stiffening elements 10, the total width and/or total length of the stiffened pallet 1' does not then, however, any longer correspond to the total width and/or total length of the pallet 1.

Figure 5:
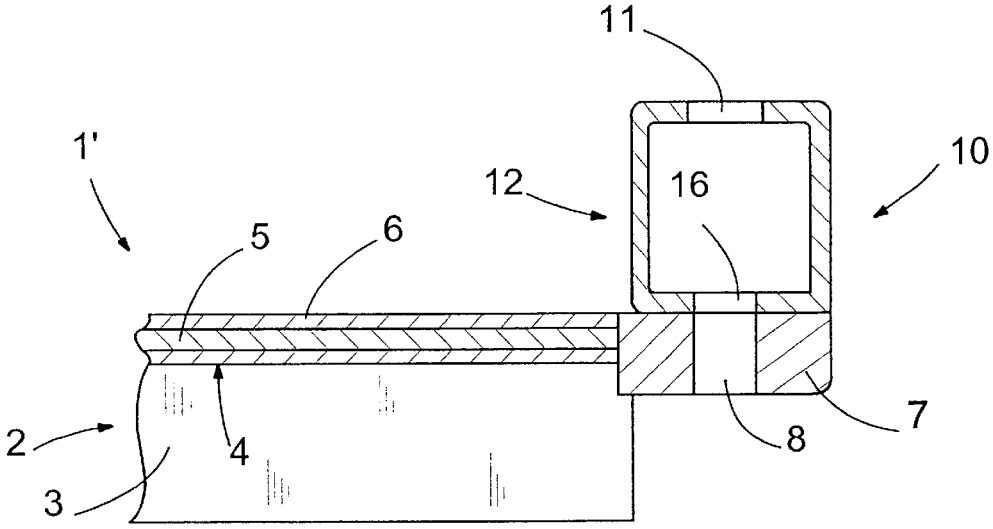
FIG. 5 is a schematic cross-sectional end view showing the pallet of FIG. 3 at corner elements of the pallet, FIG. 6 schematically shows how the pallet of the invention is used for conveying a load.

FIG. 5 is a schematic cross-sectional view showing the pallet 1' of FIG. 3 along line C—C. At the locking hole 8 of the corner element 7, the stiffening element 10 comprises a fastening hole 16, through which the stiffening element 10 can be fastened to the pallet 1' by employing an ordinary procedure for locking containers in a manner known per se. In the embodiment shown in FIG. 5, the corner element 7 has such a height that the lower surface of the corner element 7 is located below the edge 4. Consequently, the gripping part 13 of the stiffening element 10 is cut not to reach the corner element 7. If the edge 4 of the pallet 1' and the lower surface of the corner element 7 are coplanar, the stiffening element 10 can also be implemented by extending the gripping part 13 below the corner element 7. In such a case, the gripping part 13 is also provided with a fastening hole for fastening the stiffening element 10 to the pallet 1'.

Figure 6:
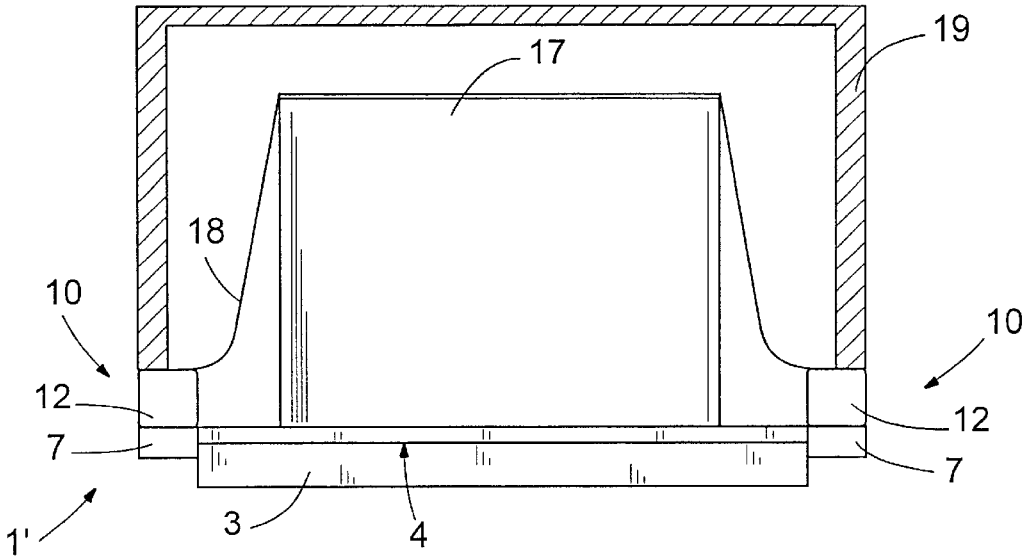

FIG. 6 is a schematic end view showing the pallet 1' of the invention conveying a load 17. The pallet 1' is stiffened in the longitudinal direction by stiffening elements 10 arranged in its both sides. An end of the pallet 1' can also be provided with a stiffening element but for the sake of clarity, this has not been shown in FIG. 6. In FIG. 6, the load 17 has been covered by a waterproof weather guard 18 arranged around the load 17 and fastened to the stiffening elements 10 such that the joint between the stiffening element 10 and the weather guard 18 is watertight. The weather guard 18 is made e.g. of waterproof material or fabric with a waterproof coating. Since both the joint between the stiffening element 10 and the pallet 1' and the joint between the stiffening element 10 and the weather guard 18 are watertight, the pallet 1' and the load 17 laid thereon can be conveyed e.g. in an open wagon without the load 17 getting wet. The weather guard 18 can be fastened to the stiffening elements 10 e.g. by fastening means arranged in the stiffening elements 10. A fastening means can be e.g. a bar arranged in the stiffening element such that the bar can be turned into two different positions, allowing the weather guard 18 to be placed between the stiffening element 10 and the bar, after which the bar is turned into a position where it presses the weather guard 18 against the stiffening element 10. However, the joint between the weather guard 18 and the stiffening element 10 or the pallet 1' can be implemented in many ways so as to enable a watertight joint to be achieved. When the load 17 is subjected to extremely difficult weather conditions, during sea transport for instance, in addition to or instead of the weather guard 18, the load 17 can be protected by a fixed protective housing 19 which comprises walls and a roof and which is to be arranged in connection with the stiffening elements 10. The fixed protective housing 19 is arranged in connection with the stiffening elements 10 such that the joints between the protective housing 19 and the stiffening elements 10 are close. If necessary, a separate sealing element is arranged between the stiffening element 10 and the protective housing 19. The fixed protective housing 19 can be formed in many ways, and it can be a single uniform piece or a combination of several parts. The fixed protective housing 19 can be locked to the fastening points 11 in the stiffening elements 10 e.g. by employing an ordinary procedure for locking containers, in which case a container formed from the pallet 1' using the fixed protective housing 19 can be lifted by its ends by means of ordinary container lifters. If the size of the pallet 1' corresponds to that of the bottom of a twenty-feet container typically used in sea transport, the pallet 1' becomes a container fit for sea transport when the fixed protective housing 19 is arranged in connection with the pallet 1'. Since the pallet 1' of the invention can also be transported by road, the pallet 1' can be made into a container fit for sea transport at the very factory, enabling the container and the load 17 therein to be directly shipped in the port with no need to move the load 17 to a special sea container for transportation. The fact that the load 17 can be loaded and fastened onto the pallet before arranging the stiffening elements 10 and the weather guard 18 or the fixed protective housing 19 in the pallet makes loading easy, and the load 17 is subjected to extremely little damage. It is to be noted herein that FIG. 6 shows the load 17, the weather guard 18 and the fixed protective housing 19 lower than they typically are in reality compared to the pallet 1'.

Adapters can be attached to the corners of the pallet 1' below the corner elements 7 to enable the pallet 1', or the container formed from the pallet using the fixed protective housing 19, to be locked to a container situated below when the containers are arranged on top of each other e.g. on-board a ship. The locking can be implemented by employing a typical procedure for locking containers. An adapter may vary in height, preferably, however, having a height to enable the pallet 1' to rest on top of the container situated below, supported by the adapters at its corners. Preferably, the adapters are not arranged in connection with the pallet 1' until in the port, while being shipped.

Figure 7:
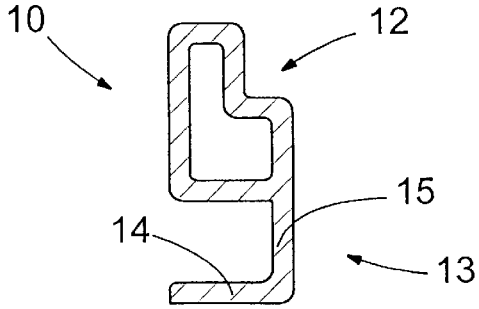
FIG. 7 is a schematic cross-sectional view showing a second embodiment of a stiffening element used in the pallet of the invention.

FIG. 7 schematically shows a second embodiment of the stiffening element 10 wherein the stiffening part 12 of the stiffening element 10 is partly reduced on the side facing the outer edge of the pallet 1'. The reduced stiffening part 12 can e.g. provide support for the fixed protective housing 19. The reduced stiffening part 12 may also be high enough to constitute the walls of the fixed protective housing 19.

The size and shape of the stiffening elements 10 may differ in many ways from those disclosed in the examples, and so does the way in which the stiffening elements are fastened to the pallet. For instance, the stiffening element 10 arranged in the side of the pallet 1' can thus be shorter than the total length of the pallet 1'. Furthermore, it is obvious that the structures of the stiffening elements located in the sides and at the ends of the pallet 1' may differ from each other and that they can be arranged in connection with each other such that they can be fastened to the pallet 1' through a single locking procedure.

Figure 8:
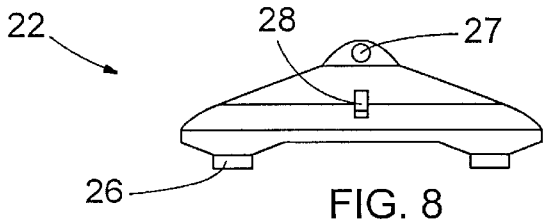
FIG. 8 is a schematic front view showing a third stiffening element of the invention.
Figure 9:
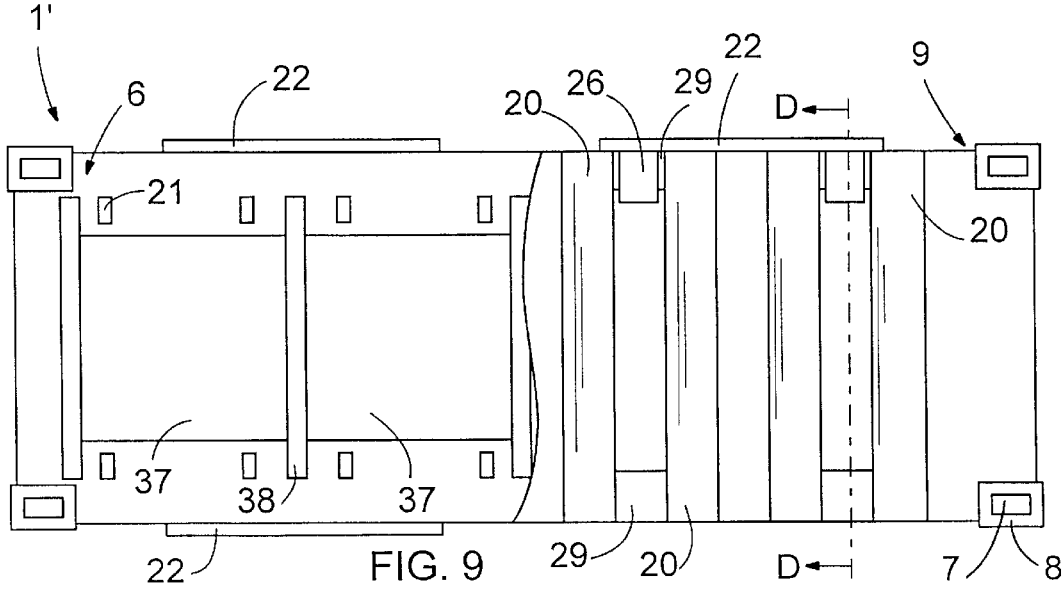
FIG. 9 is a schematic, partly sectional top view showing a second pallet 1' of the invention.
Figure 10:
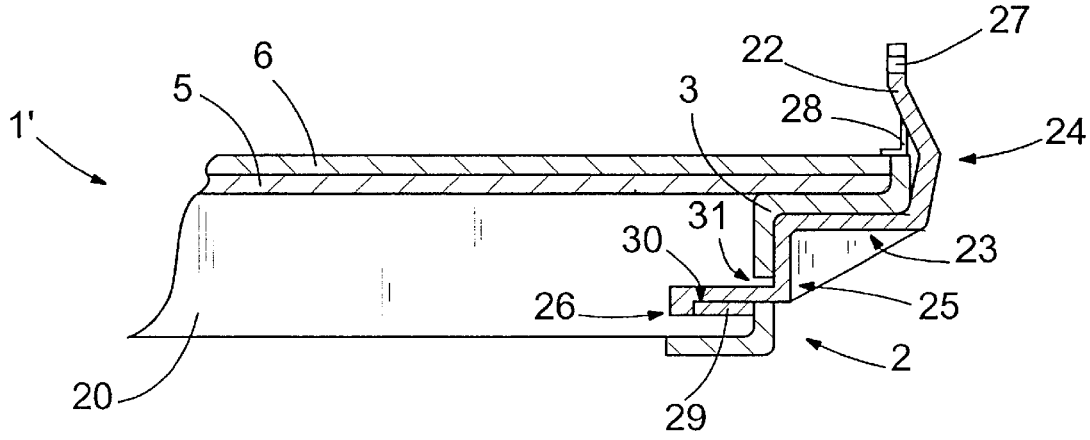
FIG. 10 is a schematic, partly sectional view showing the stiffening element of FIG. 8 as seen from an end of the pallet.

FIG. 8 is a schematic front view showing a third stiffening element 22 of the invention. FIG. 9 is a schematic, partly sectional top view showing a second pallet 1' when the stiffening element 22 of FIG. 8 is used in connection with the pallet 1'. FIG. 10 is a partly sectional view showing the stiffening element 22 as seen from an end of the pallet 1 of FIG. 9 along line D—D in FIG. 9. The stiffening element 22 disclosed in FIGS. 8 to 10 comprises a horizontal flange 23 to be arranged below the edge 4 of the pallet 1'. One end of the horizontal flange 23 is provided with an upwards pointing vertical flange 24 and the other end of the horizontal flange 23 is provided with a downwards pointing vertical flange 25. Preferably, the upwards pointing vertical flange 24 is bent as shown in FIG. 10 in order to further stiffen the structure of the stiffening element 22. The upper part of the vertical flange 24 is provided with a lifting hole 27 to receive a lifting hook or the like of a loader in order to enable the pallet 1' to be lifted by the stiffening elements 22. An end of the downwards pointing vertical flange 25 is provided with a hook part 26. One stiffening element preferably comprises two hook parts 26 but there can also be more than two hook parts 26 in one stiffening element 22. Furthermore, FIGS. 8 to 10 show a supporting member 28 for the stiffening element 22 to enable the stiffening element 22 to be arranged in its place in the pallet 1' before the pallet 1' is lifted. Supporting elements 29 supported against the profiled rail 3 and/or the frame bars 20 are arranged between the frame bars 20 of the pallet 1'. The profiled rail 3 is provided with apertures 31 at the supporting elements 29 such that the lower edge of an aperture 31 is at the same height as the upper edge of a supporting element 29. The apertures 31 in the profiled rail 3 enable the hook parts 26 of the stiffening element 22 to be arranged in connection with the supporting elements 29.

Figure 11:
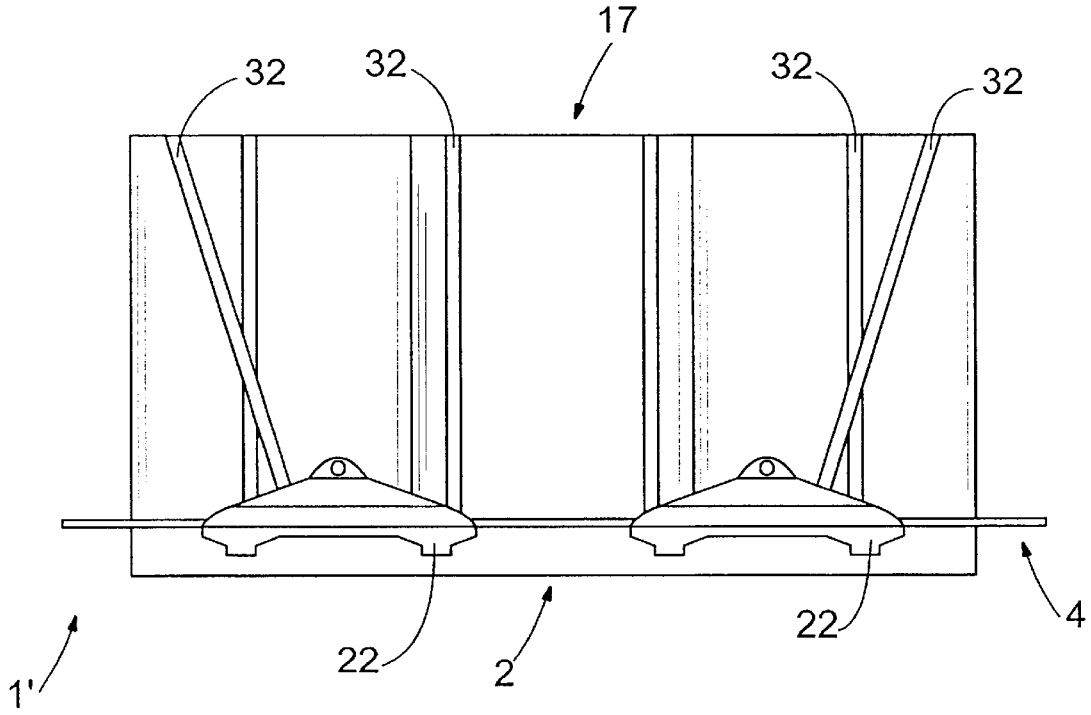
FIG. 11 is a schematic side view showing how the stiffening element of FIG. 8 is used in connection with a pallet carrying a load, and FIG. 12 schematically shows a road transport means on which the pallet is to be conveyed in road transport.

FIG. 11 is a schematic side view showing the pallet 1' carrying the load 17 and the stiffening elements 22 arranged in connection with the pallet 1' for lifting the pallet 1'. Both sides of the pallet 1' are provided with two stiffening elements 22 placed at a distance from the ends of the pallet 1'. The load 17 is tied to the clamps 21 of the pallet 1' by vertical and diagonal belts 32 and clamping devices, which, for the sake of clarity, have been omitted from FIG. 11. When the pallet 1' is lifted by lifting means arranged into the lifting holes 27 in the stiffening elements 22, the downwards pointing vertical flange 24 of the stiffening elements 22 is supported against the profiled rail 3 while the hook parts 26 of the stiffening elements 22 are supported against the supporting elements 29 of the pallet 1', the stiffening elements thus stiffening the structure of the pallet 1' in the longitudinal direction. In addition to the stiffening elements 22, the fastening of the load also stiffens the pallet 1' in the longitudinal direction, i.e. the stiffening elements 22 and the fastening of the load combine to stiffen the pallet 1' in the longitudinal direction, enabling the loaded pallet 1' to be lifted without the pallet substantially bending in the longitudinal direction.

Figure 12:
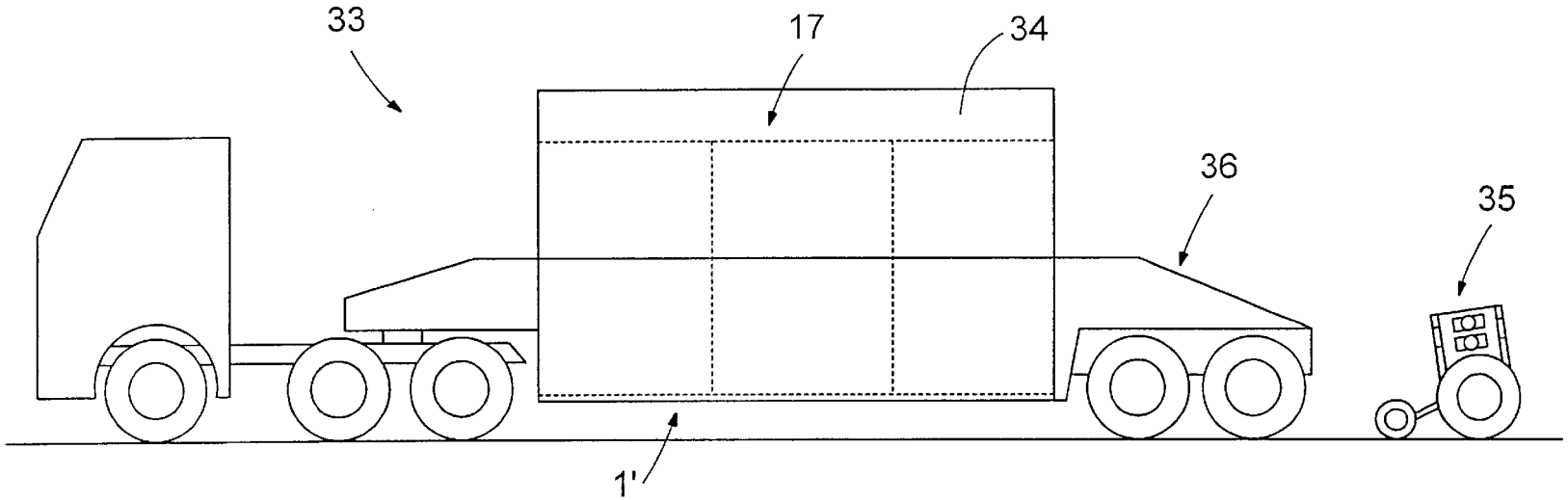

FIG. 12 is a schematic side view showing a road transport means 33 by which the pallet 1' is to be conveyed in road transport. A cargo space 34 of the transport means 33 of FIG. 12 has an open bottom. The transport means 33 comprises vertically moving supporting elements (which, for the sake of clarity, have been omitted from FIG. 12) enabling the transport means 33 to receive and carry the pallet 1' and the load 17 arranged thereon to be rested on the edges 4 of the pallet 1', without being assisted by a forklift truck or a loader. In FIG. 12, the pallet 1' and the load 17 arranged thereon are designated by broken lines inside the cargo space 34. When the pallet 1' is interlocked with the transport means 33 by the locking elements to be arranged into the locking holes 8 of the pallet 1', the pallet 1' constitutes the bottom of the cargo space 34 of the transport means 33, which stiffens the structure of the transport means 33. In order to move the pallet 1' and the load 17 arranged thereon into the cargo space 34, both sides of the cargo space 34 are provided with auxiliary wheel units 35, after which a rear wheel unit 36 located in the rear of the transport means 33 and connected to the rear section of the cargo space 34 during a normal run is detached from the transport means 33. The transport means 33 is thus capable of receiving and carrying the pallet 1' and the load 17 arranged thereon by moving the transport means 33 such that the cargo space 34 of the transport means 33 moves around the pallet 1', the supporting elements in the cargo space 34 thus simultaneously moving below the edges 4 of the pallet 1', which means that the pallet 1' and the load 17 thereon can be lifted from the ground to be rested on the edges 4 of the pallet 1' to be supported by the transport means 33.

In the manner schematically shown in FIG. 9, the pallet 1' can also be provided with one or more cavities 37, which can be arranged almost over the entire length of the pallet 1'. A cavity 37 enables the load 17 to be partly arranged inside the frame 2 of the pallet 1', which allows the height of the load 17 to be transported by the transport means 33 to be increased. The cavity 37 in FIG. 9 is rectangular, but it is obvious that the shape of the cavity 37 can vary according to the cross section of the bottom of the load 17, which also affects the way in which the frame bars 20 of the pallet 1' are shaped in order to implement the cavity 37. The structure of the pallet 1' equipped with cavities 37 can be strengthened by providing the pallet 1' with reinforcing elements 38 running across the pallet 1'.

The drawings and the related description are only intended to illustrate the idea of the invention. In its details, the invention may vary within the scope of the claims.

What is claimed is:

1. A pallet comprising:

a frame whose upper part, at least at sides thereof, is provided with edges projecting from the pallet, a frame structure being arranged inside the frame, and a loading surface onto which a load is to be arranged, wherein both sides of the pallet are provided with stiffening elements arranged to stiffen the pallet in a longitudinal direction, enabling the pallet, even while carrying a load, to be lifted without the pallet substantially bending in the longitudinal direction, the stiffening elements engage the outermost edges of the frame, and the stiffening elements define outermost edges of the pallet in the longitudinal direction.

2. A pallet as claimed in claim 1, wherein the frame structure of the pallet comprises frame bars running across the pallet and supported against the frame on both sides of the pallet.

3. A pallet as claimed in claim 1, wherein corners of the pallet are provided with corner elements comprising locking holes and the stiffening elements comprise fastening holes aligned with the locking holes.

4. A pallet comprising:

a frame whose upper part, at least at sides thereof, is provided with edges projecting from the pallet;

a frame structure being arranged inside the frame; and a loading surface onto which a load is to be arranged, wherein both sides of the pallet are provided with stiffening elements arranged to stiffen the pallet in a longitudinal direction, enabling the pallet, even while carrying a load, to be lifted without the pallet substantially bending in the longitudinal direction, and both sides of the pallet are provided with at least two stiffening elements detachably lockable to the frame through holes in the frame, and when the loaded pallet is lifted by the stiffening elements, the stiffening elements and the load tied to the pallet combine to stiffen the pallet, enabling the pallet, even while carrying a load, to be lifted without the pallet substantially bending in the longitudinal direction.

5. A pallet as claimed in claim 4, wherein a stiffening element comprises a horizontal flange to be arranged below an edge of the pallet, one end of the horizontal flange being provided with an upwards pointing vertical flange equipped with a lifting hole and the other end being provided with a downwards pointing vertical flange, which comprises at least two hook parts and which is to be supported against the frame of the pallet, and in that the pallet comprises, between the frame bars, supporting elements supported against the frame and/or the frame bars, and apertures provided in the frame at an upper surface of the supporting elements, enabling the stiffening element to be arranged in the pallet by arranging the hook parts of the stiffening element in connection with the supporting elements through the apertures in the frame.

6. A pallet as claimed in claim 1, wherein both sides of the pallet are provided with separate stiffening elements arranged to stiffen the pallet in the longitudinal direction, enabling the pallet, even while carrying a load, to be lifted by its ends without the pallet substantially bending in the longitudinal direction.

7. A pallet as claimed in claim 6, wherein both ends of the pallet are provided with separate stiffening elements arranged to stiffen the pallet in the lateral direction.

8. A pallet as claimed in claim 6, wherein the stiffening elements are detachable from the pallet.

9. A pallet as claimed in claim 6, wherein a stiffening element comprises a stiffening part to be arranged on top of the pallet, and a gripping part comprising a horizontal flange to be arranged below the edge of the pallet and a vertical flange connecting the stiffening part and the horizontal flange.

10. A pallet as claimed in claim 9, wherein the stiffening part comprises a cross-section having an enclosed and hollow perimeter.

11. A pallet comprising:

a frame whose upper part, at least at sides thereof, is provided with edges projecting from the pallet;

a frame structure being arranged inside the frame; and a loading surface onto which a load is to be arranged, wherein corners of the pallet are provided with corner elements comprising locking holes both sides of the pallet are provided with separate stiffening elements arranged to stiffen the pallet in the longitudinal direction, and the stiffening element comprises fastening holes for fastening the stiffening element to the pallet by fastening elements to be arranged into the locking holes of the pallet.

12. A pallet as claimed in claim 11, said stiffening elements further comprising fastening points in proximity to said locking holes, wherein the stiffening element is arranged to be fastened to the pallet by locking through said fastening points and said locking holes.

13. A pallet as claimed in claim 6, wherein a sealing element is arranged between the pallet and the stiffening element.

14. A pallet as claimed in claim 6, wherein a waterproof weather guard is arranged in connection with the stiffening elements to cover the load.

15. A pallet as claimed in claim 6, wherein a fixed protective housing is arranged in connection with the stiffening elements to cover the load.

16. A pallet as claimed in claim 15, wherein the fixed protective housing is foldable and dismountable.

17. A pallet as claimed in claim 3, wherein the sides and ends of the pallet, excluding the point where the corner elements are located, are provided with reductions enabling the stiffening elements to be arranged in connection with the pallet such that the total width and the total length of the pallet remain substantially the same.

18. A pallet as claimed in claim 1, wherein the pallet is provided with at least one cavity to enable the load to be partly arranged inside the frame of the pallet.

19. A pallet as claimed in claim 1, wherein the size of the pallet in the longitudinal and lateral directions is matched with that of the bottom of a twenty-feet container used in sea transport.

20. A pallet as claimed in claim 1, wherein the pallet is arranged to be locked to a cargo space of a road transport means such that the pallet constitutes the bottom of the cargo space.

21. A pallet comprising:

a frame whose upper part, at least at sides thereof, is provided with edges projecting from the pallet;

a frame structure being arranged inside the frame;

a loading surface onto which a load is to be arranged; and detachable stiffening elements detachably attached to the frame edges on both sides of the frame and arranged to stiffen the pallet in a longitudinal direction, enabling the pallet, even while carrying a load, to be lifted without the pallet substantially bending in the longitudinal direction, the detachable stiffening elements comprising a stiffening part having a cross-section with an enclosed and hollow perimeter.

* * * * *